US005828541A

United States Patent [19]

Wu

[11] Patent Number: 5,828,541

[45] Date of Patent: Oct. 27, 1998

[54] HANGING ASSEMBLY FOR A TIMER

[76] Inventor: Chien-Dau Wu, No. 282, Lung-Kang Rd., Sec. 1, Chung-Li, Taiwan

[21] Appl. No.: 542,019

[22] Filed: Oct. 12, 1995

[51] Int. Cl.[6] ..... G04B 37/00

[52] U.S. Cl. ..... 368/278; 368/316; 368/10

[58] Field of Search ..... 361/282, 301–309; 368/285, 278, 10

[56] References Cited

U.S. PATENT DOCUMENTS

| | | | |
|---|---|---|---|
| 1,153,075 | 9/1915 | Hataway | 368/282 |
| 2,274,207 | 2/1942 | Merz | 368/282 |
| 2,591,078 | 4/1952 | Lazrus | 368/282 |

*Primary Examiner*—Bernard Roskoski
*Attorney, Agent, or Firm*—Bacon & Thomas

[57] ABSTRACT

A hanging structure of a timer or watch and the like, wherein an annular groove is provided on the periphery of the timer, the annular groove receives a plurality of balls provided on the ends of a plurality of hanging columns, the hanging columns can slide along the annular groove and around the timer under guiding of the annular groove, a hanging ring is provided on one end of each of the hanging columns for hanging keys or a remote controller for an automobile etc., so that the timer can have the functions of a pendant watch and a key ring, the hanging ringing is attached to a chain, so that the timer can be used as a pendant watch, an object of multifunction of the structure can thus be achieved.

2 Claims, 5 Drawing Sheets

FIG. 5
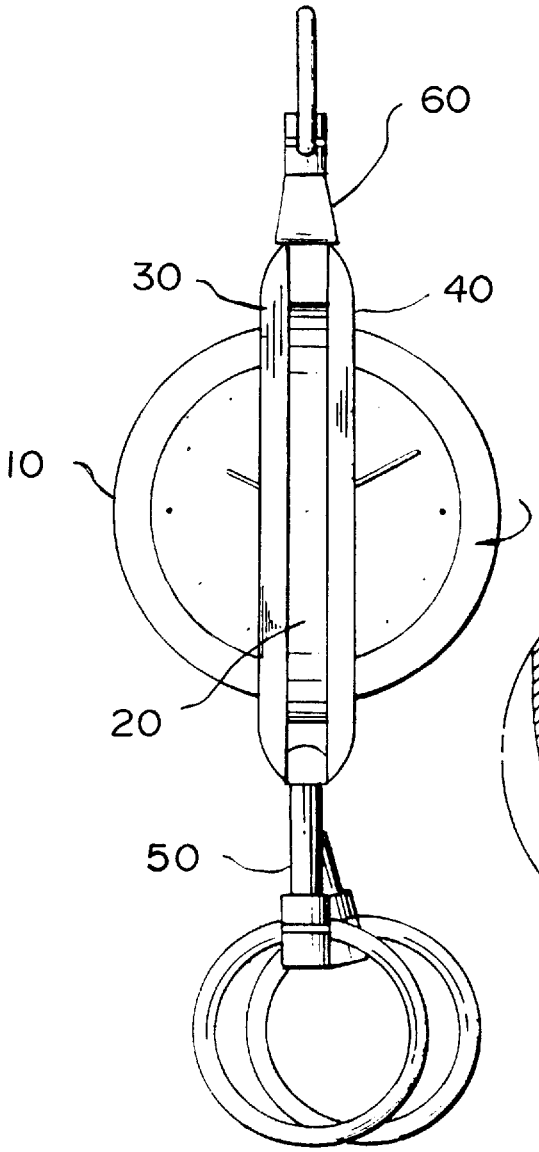
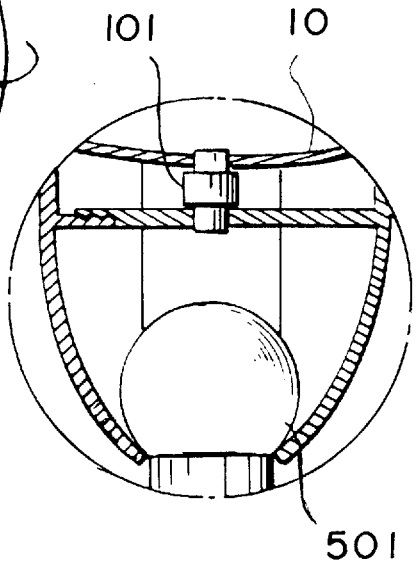
FIG. 5A

HANGING ASSEMBLY FOR A TIMER

BACKGROUND OF THE INVENTION

1. Field of the Invention

The present invention relates to a hanging structure of a timer or watch and the like, wherein an annular groove is provided on the periphery of the timer, the inner bottom of the groove is wider than the outer opening thereof, a plurality of hanging column can thereby embedded in the annular groove, the hanging columns can slide along the annular groove and around the periphery of the timer, thereby, the hanging columns can carry a lot of articles such as keys, this is convenient for a user of the timer.

2. Description of the Prior Art

A timer such as a wrist watch, a pendant watch, a necklace watch etc. in the markets have various forms and styles of design, for example, precious decoration articles such as diamond or gold may be inlaid thereon to bestow a sense of luxuriance and valuables; or the forms of the dial or the band of a watch may be changed to have a special and novel appearance for attracting the consumers for buying. The conventional techniques stated above are only matters of decoration, they just can not satisfy the requirement of the consumers in the age which is looking for equisiteness and multi-effect, now a days.

SUMMARY OF THE INVENTION

In view of this, the inventor of the present invention studied and improved continuously based on his professional experience of years in manufacturing and selling various delicate timers, and finally provides practical as well as delicate and good looking timers, in this way, the area of usage of the timers can be enlarged, production of watch can thereby be further advanced.

In particular, the hanging structure of a timer or watch and the like of the present invention is provided with an annular groove on the periphery of the timer, the annular groove is formed by combining a front and a rear case bodies around the timer, while when the case bodies are assembled, a gap is left on the outer periphery thereof to form the groove, both rims of the gap is slightly protruded inwardly, the inner bottom of the groove is thereby wider than the outer opening thereof, a plurality of hanging columns can thereby embedded in annular groove by means of the balls provided thereon, the hanging columns can thereby slide along the annular groove and not to fall off, thereby, each of the hanging columns can be provided with a hanging ring which can carry an article such as key or remote controller for an automobile etc., so that the timer can have the function other than just a timer.

The principal object of the present invention is to provide a multi-functional timer, wherein a fixed hanging ring is provided on the annular groove, the fixed hanging ring can be used for attaching a chain to form the timer as a pendant watch for timing; a plurality of little articles such as keys can be hung on the hanging column as is the way of a key ring. The novel structure of the present invention can thereby have more than one function, the area of usage of the timers thus is enlarged.

The second object of the present invention is to provide a structure of timer which is convenient for use, wherein the hanging column can be moved and slide along the annular groove, therefore, the hanging column, as to its key ring function for hanging keys etc., can be used optionally for hanging keys or a remote controller for an automobile etc., so that the timer is convenient for use.

Another object of the present invention is to provide a pendant watch having fun, when in use, the annular groove can be separated from the timer, an axle can be provided respectively on the top and the bottom of the watch and is respectively pivotably extended through the upmost and downmost ends of the annular groove, so that the timer can be rotated forwardly and backwardly taking the axles as its center, a kind of fun thus is provided.

The present invention will be apparent in its practical functions after reading the detailed description of the preferred embodiments thereof in reference to the accompanying drawings.

BRIEF DESCRIPTION OF THE DRAWINGS

FIG. 5 is a side view of the second embodiment of the present invention; and FIG. 5A is an enlarged view showing the attachment of the hanging column to the case bodies.

DETAILED DESCRIPTION OF THE PREFERRED EMBODIMENT

Figure 1:
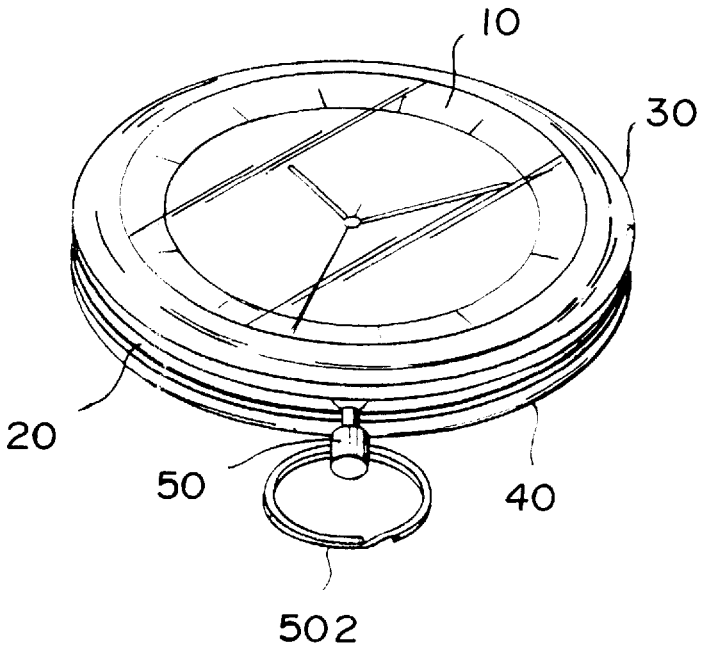
FIG. 1 is a perspective view of a basic embodiment of the present invention.
Figure 2:
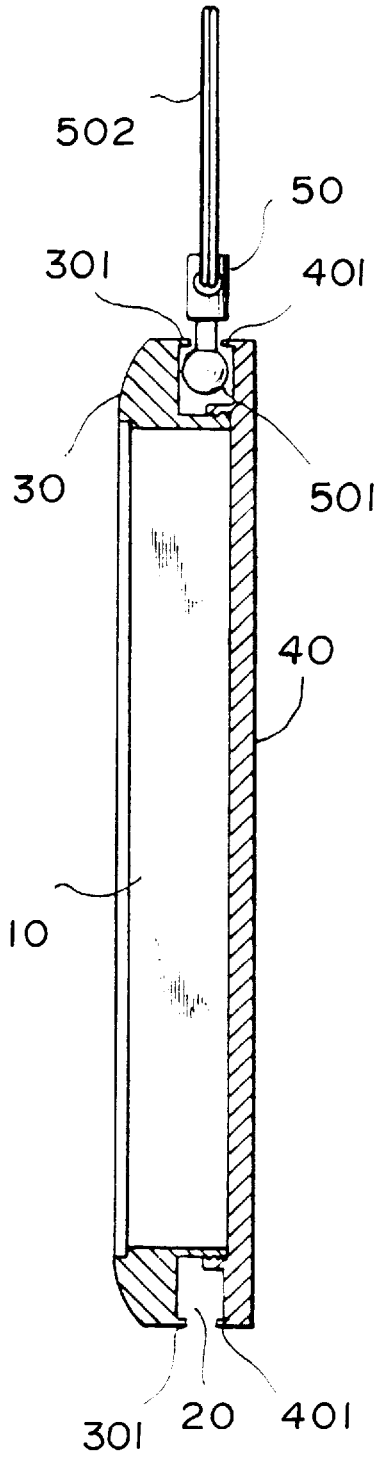
FIG. 2 is a side sectional view of the basic embodiment of the present invention.

As is shown in FIG. 1 and 2, the structure of the basic embodiment of the present invention comprises a timer 10 which is provided with an annular groove 20 on the periphery thereof, the annular groove 20 is formed by combining a front and a rear case bodies 30, 40 around the timer 10; while the outer rims 301, 401 of the case bodies 30, 40 are slightly protruded inwardly, and when the case bodies 30, 40 are assembled, a gap is left on the outer periphery thereof to form the annular groove 20, the inner bottom of the annular groove 20 is thereby wider than the outer opening thereof, this is mainly for providing a plurality of hanging columns 50, the end of each hanging column 50 is enlarged to form a ball 501 having a larger diameter which can be received in the annular groove 20, the diameter of the hanging column 50 proper is such that it can slide along the annular groove 20, i.e., it is limited by the gap between the outer rims 301, 401 of the case bodies 30, 40, the hanging column 50 is not to fall off the annular groove 20 by means of the ball 501, and can be moved as well as slided along the annular groove 20 and around the timer 10; a hanging ring 502 is provided on one end (being exposed out of the annular groove 20) of each hanging column 50, the hanging ring 502 is attached with a chain to be used as a key ring, or to render the watch to be used as a pendant watch, or otherwise, more than two hanging columns 50 can be provided for connecting respectively a chain, a plurality of keys and an article such as a remote controller for an automobile etc., so that the timer can have the functions of a pendant watch and a key ring.

Figure 3:
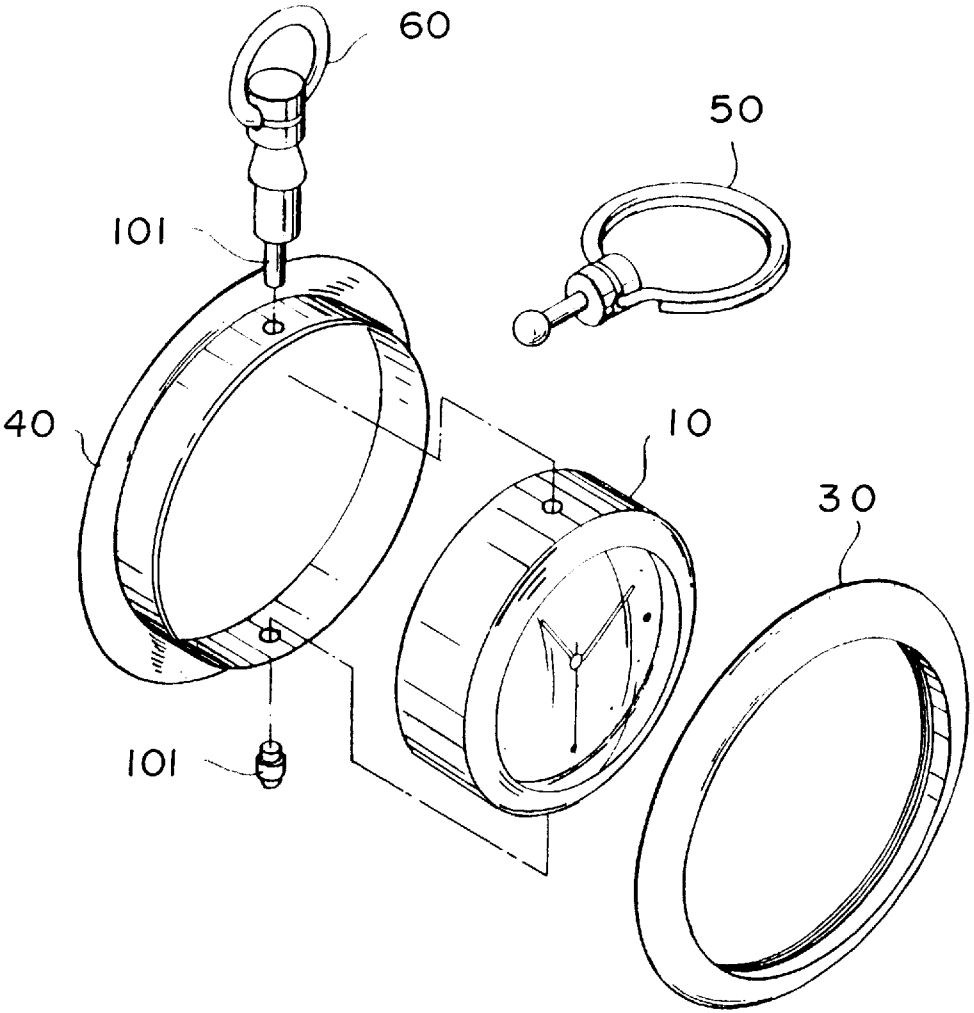
FIG. 3 is an exploded perspective view of a second embodiment of the present invention.
Figure 4:
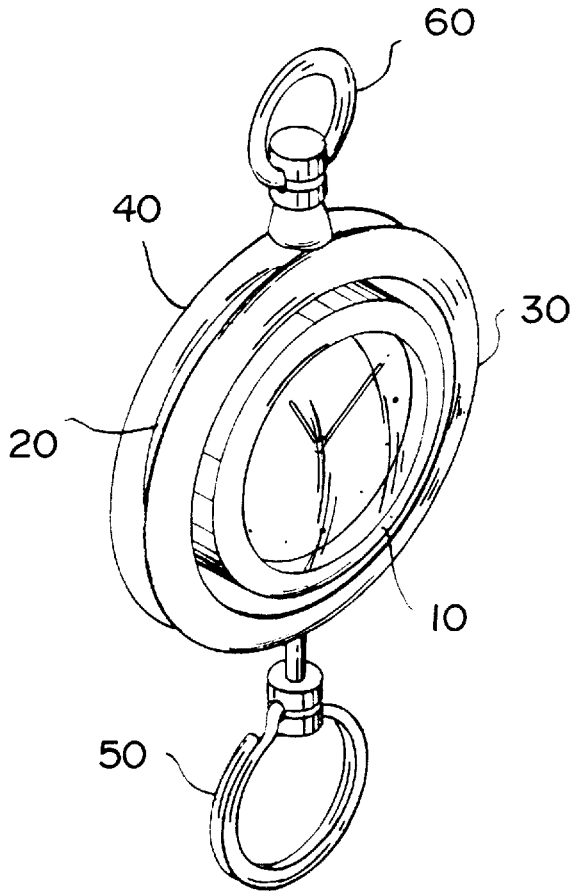
FIG. 4 is a perspective view of the second embodiment of the present invention after assembling.

Another embodiment of the present invention can be seen in FIG. 3 to 5, wherein the front and rear case bodies 30, 40 are in annular shapes, the front and rear case bodies 30, 40 envelop the timer 10 (as shown in FIG. 3) while keep a distance therefrom (as shown in FIG. 4), the timer 10 has an axle 101 respectively on the top and the bottom thereof with each axle 101 being respectively pivotably provided in the upper and lower inner sides of the front and rear case bodies 30, 40, in this way, the timer 10 can be pivoted in taking the coaxial axles 101 as its center of rotation (as shown in FIGS. 5 and 5A), whereby a kind of fun can be provided. Besides, a fixed hanging ring 60 is provided on the outer surface of the case bodies 30, 40, the fixed hanging ring 60 is provided at the 12 o'clock or due upmost position, or at the due downmost position, so that a chain can be used for attaching to the hanging ring 60 to form a pendant watch for showing time when in need.

Therefore, we can see from the above two embodiments that the unique structure of the present invention renders the timer 10 to have both the functions of a pendant watch and a key ring, and when the structure is used as a key ring, the sliding motion of the hanging columns 50 renders selection and using of the keys or the remote controller to be convenient, pivoting ability of the timer 10 can have a kind of fun, the present invention is promotive for the production of industry by virtue of its functional as well as decorative improvement.

Obviously, many modifications and variations of the present invention are possible in the light of the above teachings. It is therefore to be understood that within the scope of the appended claims, the invention may be practised otherwise than as specifically described.

I claim:

1. A hanging assembly for a timer comprising:

a) an annular front case body and an annular rear case body, the case bodies being combined together to define a frame for supporting a timer therein;

b) the case bodies each including an outer rim terminating in an inwardly directed annular flange, the outer rims collectively defining an annular groove and the flanges collectively defining an annular slot, wherein the width of the groove is larger than the width of the slot;

c) a pair of opposed pivotal axles carried by the case bodies and extending inwardly of the frame for defining a common pivotal axis, and a timer mounted to the axles and spaced inwardly of the frame for pivotal movement about the common axis; and d) at least one moveable hanging column carried by the frame, the hanging column including a shaft provided with an enlarged portion at a first end thereof and a hanging ring at a second end thereof, the enlarged portion having a width exceeding the width of the annular slot, the enlarged portion being captured within the annular groove and the shaft extending outwardly from the annular slot for permitting the column to freely slide around the annular groove and the attachment of an article to the hanging ring.

2. The hanging assembly of claim 1 wherein the timer is a watch and further including a stationary hanging column mounted to the frame adjacent the 12 O'clock position of the watch and a plurality of movable hanging columns.

* * * * *